US008376762B2

(12) United States Patent
Ozeki

(10) Patent No.: US 8,376,762 B2
(45) Date of Patent: Feb. 19, 2013

(54) ELECTRICAL CONNECTOR HAVING A SHELL WITH A HOLDING PORTION AND A RELEASING PORTION

(75) Inventor: Kosuke Ozeki, Tokyo (JP)

(73) Assignee: Dai-Ichi Seiko Co., Ltd. (JP)

( * ) Notice: Subject to any disclaimer, the term of this patent is extended or adjusted under 35 U.S.C. 154(b) by 0 days.

(21) Appl. No.: 13/237,680

(22) Filed: Sep. 20, 2011

(65) Prior Publication Data

US 2012/0083150 A1 Apr. 5, 2012

(30) Foreign Application Priority Data

Oct. 5, 2010 (JP) ..... 2010-225857

(51) Int. Cl.
*H01R 13/62* (2006.01)

(52) U.S. Cl. ..... 439/153

(58) Field of Classification Search ..... 439/153–160
See application file for complete search history.

(56) References Cited

U.S. PATENT DOCUMENTS

| | | | | |
|---|---|---|---|---|
| 7,422,472 | B2 | 9/2008 | Hashiguchi et al. | |
| 8,002,567 | B2 * | 8/2011 | Hara | 439/329 |
| 8,221,147 | B2 * | 7/2012 | Ozeki | 439/260 |
| 2008/0050958 | A1 | 2/2008 | Hashiguchi et al. | |
| 2011/0034050 | A1 * | 2/2011 | Zhu et al. | 439/159 |
| 2012/0208385 | A1 * | 8/2012 | Ozeki | 439/153 |
| 2012/0220171 | A1 * | 8/2012 | Shimada et al. | 439/660 |

FOREIGN PATENT DOCUMENTS

| | | |
|---|---|---|
| JP | 2008-052993 A | 3/2008 |
| JP | 2008-192574 A | 8/2008 |

* cited by examiner

*Primary Examiner* — Chandrika Prasad
(74) *Attorney, Agent, or Firm* — Studebaker & Brackett PC; Donald R. Studebaker

(57) ABSTRACT

An electrical connector comprising a housing provided on one of opposite end portions thereof with an opening through which an FPC is inserted into the housing, a plurality of conductive contacts arranged on the housing for coming into contact with signal connecting terminals on the FPC inserted in the housing, and a shell member mounted on the housing and provided therein with a holding portion operative to hold the FPC inserted in the housing, a releasing portion operative to release the FPC from holding by the holding portion and a connecting portion for connecting the releasing portion with the holding portion, wherein the releasing portion extends from the shell member, the connecting portion extends to be bent from the releasing portion, and the holding portion extends to be bent from the connecting portion, so that a U-shaped portion is constituted in the shell member with the releasing portion, the connecting portion and the holding portion.

6 Claims, 14 Drawing Sheets

ELECTRICAL CONNECTOR HAVING A SHELL WITH A HOLDING PORTION AND A RELEASING PORTION

BACKGROUND OF THE INVENTION

1. Field of the Invention

The present invention relates generally to an electrical connector, and more particularly to an improvement in an electrical connector which has a housing, holding means for engaging with a flat circuit device, such as a flexible printed circuit board (hereinafter, referred to as an FPC) or a flexible flat cable assembly (hereinafter, referred to as an FFC) inserted in the housing, so as to hold the same to be prevented from getting out of the housing unwillingly and a plurality of conductive contacts provided for coming into contact with connecting terminals provided on the flat circuit device so as to put the flat circuit device in electrical connection with another electrical device, such as a main solid circuit board.

2. Description of Related Art Including Information Disclosed Under 37 CFR 1.97 and 37 CFR 1.98

A flat circuit device, such as a relatively small-sized FPC or FFC, used in various kinds of electronic apparatus is often mounted on a main solid circuit board, on which various electrical parts are directly mounted, with an electrical connector which is fixed to and connected electrically with the main solid circuit board. The electrical connector has a plurality of conductive contacts, an end portion of each of which is connected electrically with a conductive circuit pattern portion formed on the main solid circuit board and which are provided for coming into contact with connecting terminals provided on the flat circuit device, and is operative to connect electrically, through the conductive contacts, each of the connecting terminals provided on the flat circuit device with the conductive circuit pattern portion formed on the main solid circuit board.

A first type of previously proposed electrical connector used for connecting electrically a flat circuit device, such as an FPC, with a main solid circuit board, has a housing made of insulator, which is mounted on the main solid circuit board and has an opening through which at least a part of the flat circuit device is inserted into the housing. On the housing, a plurality of conductive contacts are provided to be arranged along the opening provided also on the housing. These conductive contacts are operative to come into contact respectively with a plurality of connecting terminals provided on the flat circuit device when the flat circuit device is inserted in the housing through the opening provided thereon. The previously proposed electrical connector of the first type is also provided with a shell member which covers wholly or partially the housing and is grounded to be operative to contribute to adjustment on characteristic impedance of each of the conductive contacts and to shield the conductive contacts in the housing from electromagnetic wave noises coming from the outside. The previously proposed electrical connector of the first type is further provided with an actuator which is provided to be rotatable in regard to the housing so as to engage with each of the conductive contacts arranged in the housing. When the actuator is rotated in a first direction in regard to the housing, an operating portion of each of the conductive contacts is moved by the actuator to put the conductive contact in press-contact with a corresponding one of the connecting terminals provided on the flat circuit device, and then, when the actuator is rotated in a second direction opposite to the first direction in regard to the housing, the conductive contacts put in press-contact with the connecting terminals provided on the flat circuit device are released from the press-contact with the connecting terminals. With the conductive contacts put in press-contact with the connecting terminals which are provided on the flat circuit device inserted in the housing, the flat circuit device is put in electrical connection with the main solid circuit board.

A second type of previously proposed electrical connector used for connecting electrically the flat circuit device with the main solid circuit board is provided with a housing to be mounted on the main solid circuit board, a plurality of conductive contacts and a shell member in such a manner as mentioned above but is not provided with an actuator rotatable in regard to the housing. In the previously proposed electrical connector of the second type thus constituted, when the flat circuit device is inserted into the housing through an opening provided thereon, each of the conductive contacts provided in the housing to be arranged along the opening is automatically put in press-contact with a corresponding one of connecting terminals provided on the flat circuit device. That is, the flat circuit device is put in electrical connection with the main solid circuit board by means of only inserting correctly the flat circuit device into the housing through the opening provided thereon.

In the previously proposed electrical connector with or without the actuator rotatable in regard to the housing, when the flat circuit device is inserted into the housing through the opening provided thereon and the conductive contacts arranged on the housing are put in press-contact with the connecting terminals provided on the flat circuit device so that the flat circuit device is put in electrical connection with the main solid circuit board, it is required to prevent the flat circuit device inserted in the housing from getting out of the housing unwillingly. It is a matter of course that it is necessary for the flat circuit device inserted in the housing to be held stably so as not to get out of the housing unwillingly in order to keep the conductive contacts arranged on the housing properly in a condition of press-contact with the connecting terminals provided on the flat circuit device.

There has been also proposed previously an electrical connector belonging to the above mentioned first type having the housing, the conductive contacts, the shell member and the actuator, which is provided also with holding means for engaging with a flat circuit device, such as an FPC or an FFC, inserted in the housing so as to hold the same to be prevented from getting out of the housing unwillingly, as shown in, for example, the Japanese patent application published before examination under publication number 2008-52993 (hereinafter, referred to as published patent document 1).

Besides, there has been further proposed previously an electrical connector belonging to the above mentioned second type having the housing, the conductive contact and the shell member except the actuator rotatable in regard to the housing, which is provided also with holding means for engaging with a flat circuit device, such as an FPC or an FFC, inserted in the housing so as to hold the same to be prevented from getting out of the housing unwillingly, as shown in, for example, the Japanese patent application published before examination under publication number 2008-192574 (hereinafter, referred to as published patent document 2).

In the electrical connector shown in the published patent document 1, the holding means (a locking portion 11*c*) is formed in a part of the shell member (a shield plate 11) to be able to seesaw with an engaging end portion (a claw portion 11*d*) curved to the inside of the shell member. The holding means shifts its position in response to a movement of the actuator (an actuator 9) provided to be rotatable in regard to the housing (a housing 3).

Then, when the actuator is rotated in a first direction in regard to the housing after the flat circuit device (an FPC 21) is inserted into a receiving space (an FPC receiving space 34) provided in the housing, each of the conductive contacts (first contacts 5 and second contacts 6) provided in the housing is caused by a cam (a cam portion 92 or 93) formed on the actuator to shift its position so as to be put in press-contact with a corresponding one of connecting terminals provided on the flat circuit device inserted in the housing and the holding means is caused by a com (a cam portion 94) formed on the actuator to shift its position so as to cause the engaging end portion of the holding means to engage with an engaging portion (a recess 21*a*) formed on the flat circuit device. As a result, the flat circuit device inserted in the housing is prevented from getting out of the housing unwillingly.

After that, when the actuator is rotated in a second direction opposite to the first direction in regard to the housing under a condition wherein the engaging end portion of the holding means is put in engagement with the engaging portion formed on the flat circuit device, the cam (the cam portion 94) formed on the actuator allows the holding means to release the engaging end portion of the holding means from the engagement with the engaging portion formed on the flat circuit device. As a result, the flat circuit device is put in a condition to be able to get out of the housing.

Further, in the electrical connector shown in the published patent document 2, the shell member (a shell 4) is provided to be rotatable in regard to the housing (a housing body 2) and the holding means (a leg portion 46) in the form of a leaf spring is formed in a part of the shell member. The holding means has an engaging projection (44) formed at an end of the holding means to be curved to the inside of the shell member.

When the flat circuit device (an FPC) is inserted into the housing through the opening (an opening 21) provided thereon under a condition wherein the shell member is positioned to keep lying down on the housing so as to be close in its entirety to the housing, each of the conductive contacts (upper contacts 31 and lower contacts 32) provided in the housing is caused to be put in press-contact with a corresponding one of connecting terminals provided on the flat circuit device inserted in the housing and the engaging projection formed on the holding means is caused to engage with an engaging portion (an FPC engaging hole 2) provided on the flat circuit device. As a result, the flat circuit device inserted in the housing is prevented from getting out of the housing unwillingly.

After that, when the shell member is rotated to be positioned to keep rising from the housing under a condition wherein the engaging projection formed on the holding means is put in engagement with the engaging portion formed on the flat circuit device, the holding means formed in the shell member shifts its position in response to a movement of the shell member so as to release the engaging projection provided on the holding means from the engagement with the engaging portion formed on the flat circuit device. As a result, the flat circuit device is put in a condition to be able to get out of the housing.

In each of the electrical connectors thus proposed previously, which has the holding means operative to prevent the flat circuit device inserted in the housing from getting out of the housing unwillingly, the holding means is provided to be operative to shift its position in response to rotational movements of the actuator provided to be rotatable in regard to the housing, or the shell member for covering wholly or partially the housing is provided to be rotatable in regard to the housing and the holding means is formed in a part of the shell member to be operative to prevent the flat circuit device inserted in the housing from getting out of the housing unwillingly.

In the case of the previously proposed electrical connector which has the holding means operative to shift its position in response to the rotational movements of the actuator provided to be rotatable in regard to the housing, it is required that the holding means and the actuator are provided as separate parts independent from each other and this results in problems or disadvantages that miniaturization in the electrical connector is undesirably hindered, the number of constitutive parts of the electrical connector increases undesirably and a production cost of the electrical connector rises disagreeably. Besides, it is necessary, for causing the holding means to engage with or disengage from the flat circuit device inserted in the housing, to rotate the actuator in regard to the housing and this results in undesirable increase in an open space around the electrical connector.

In the case of the previously proposed electrical connector which has the shell member provided to be rotatable in regard to the housing and the holding means formed in the part of the shell member, since the shell member is operative to rotate in regard to the housing, any part of the shell member not be used for fastening the electrical connector to the main solid circuit board so that a separate holding-down member for fastening the electrical connector to the main solid circuit board is required and this results in problems or disadvantages that miniaturization in the electrical connector is undesirably hindered, the number of constitutive parts of the electrical connector increases undesirably and a production cost of the electrical connector rises disagreeably.

BRIEF SUMMARY OF THE INVENTION

Accordingly, it is an object of the present invention to provide an electrical connector used for connecting electrically a flat circuit device, such as an FPC or an FFC, with a solid circuit board, which comprises a housing provided thereon with an opening through which a flat circuit device is inserted into the housing, a plurality of conductive contacts provided to be arranged on the housing and a shell member covering partially the housing, and which avoids the aforementioned disadvantages encountered with the prior art.

Another object of the present invention is to provide an electrical connector used for connecting electrically a flat circuit device, such as an FPC or an FFC, with a solid circuit board, which comprises a housing provided thereon with an opening through which a flat circuit device is inserted into the housing, a plurality of conductive contacts provided to be arranged on the housing and a shell member covering partially the housing, and in which the flat circuit device inserted in the housing can be put in holding by a holding member formed in the shell member to be surely prevented from getting out of the housing unwillingly and then released from the holding by the holding member to be able to get out of the housing with a structure in which the electrical connector can be miniaturized on the whole and the number of structural parts can be reduced.

A further object of the present invention is to provide an electrical connector used for connecting electrically a flat circuit device, such as an FPC or an FFC, with a solid circuit board, which comprises a housing provided thereon with an opening through which a flat circuit device is inserted into the housing, a plurality of conductive contacts provided to be arranged on the housing and a shell member covering partially the housing, and in which the flat circuit device inserted in the housing can be easily released from holding by a holding portion formed in the shell member without exerting undesirable coercive force on the solid circuit board with which the flat circuit device is connected electrically.

According to the present invention, as claimed in any one of claims, there is provided an electrical connector, which comprises a housing made of insulator to be mounted on a solid circuit board and provided thereon with an opening through which a flat circuit device, such as an FPC or an FFC, is inserted into the housing and which opens on one of a first pair of opposite end portions of the housing, a plurality of conductive contacts arranged on the housing, each of which has a contacting portion positioned in the housing and a connecting terminal portion projecting from the other of the first pair of end portions of the housing to the outside of the housing and is operative to come into contact with a connecting terminal provided on the flat circuit device inserted in the housing through the opening provided thereon, and a shell member mounted on the housing for covering partially the same and provided with a holding portion formed in a body therein and operative to be put in engagement with the flat circuit device inserted in the housing for holding the same, a releasing portion formed in a body therein and operative to release the holding portion from the engagement with the flat circuit device inserted in the housing and a connecting portion formed in a body therein for connecting the releasing portion with the holding portion, wherein the releasing portion extends from a portion of the shell member covering one of a second pair of opposite end portions of the housing to the outside of the housing on the side of said one of the first pair of opposite end portions of the housing, the connecting portion extends to be bent from the releasing portion, and the holding portion extends to be bent from the connecting portion toward the other of the first pair of opposite end portions of the housing, so that a U-shaped portion is constituted in the shell member with the releasing portion, the connecting portion and the holding portion.

In the electrical connector thus constituted in accordance with the present invention, when the flat circuit device on which the connecting terminals are provided is inserted into the housing thorough the opening provided thereon, the contacting portion of each of the conductive contacts arranged on the housing comes into contact with a corresponding one of the connecting terminals provided on the flat circuit device inserted in the housing and the holding portion formed in a body in the shell member is put in engagement with the flat circuit device inserted in the housing to hold the same. As a result, the flat circuit device inserted in the housing is held by the holding member so as to be prevented from getting out of the housing unwillingly and the conductive contacts arranged on the housing are stably kept in contact with the connecting terminals provided on the flat circuit device inserted in the housing.

Then, when the releasing portion also formed in a body in the shell member is manipulated, for example, to be shifted toward the housing, for releasing the holding portion from the engagement with the flat circuit device inserted in the housing, the releasing member operates to move the holding portion connected through the connecting portion with the releasing portion so as to cause the holding portion to disengage from the flat circuit device inserted in the housing. As a result, the flat circuit device inserted in the housing is released from holding by the holding member so as to be able to get out of the housing.

Functions or roles of the respective portions of the electrical connector constituted as mentioned above in accordance with the present invention are further explained in the concrete as follows, for example.

In the electrical connector according to the present invention, each of the holding portion and the releasing portion of the shell member is formed, for example, to constitute a resilient movable arm-shaped portion. The holding portion is, for example, provided thereon with an engaging end portion for engaging with an engaging portion provided on the flat circuit device inserted in the housing and operative to swing with a fulcrum placed at a root of the holding portion connected with the connecting portion, and the releasing portion is, for example, provided thereon with a manipulatable part on which manipulation for shifting the releasing portion toward the holding portion is exerted and operative to swing with a fulcrum placed at a root of the releasing portion connected with the shell member. When the manipulatable part of the releasing portion is manipulated to shift the releasing portion toward the holding member, the U-shaped portion which is constituted in the shell member with the releasing portion, the connecting portion and the holding portion is subjected easily to resilient deformation on the whole so that the engaging end portion of the holding portion disengages from the engaging portion provided on the flat circuit device inserted in the housing. Then, when the manipulatable part of the releasing portion is released from manipulation for pushing the releasing portion down toward the holding member, the U-shaped portion which is constituted in the shell member with the releasing portion, the connecting portion and the holding portion is restored to its condition prior to the resilient deformation by means of its own restoring resilient force.

On that occasion, the holding portion is, for example, operative to come into contact with a positioning portion provided on the housing to be restricted in its position thereby when the manipulatable part of the releasing portion is not manipulated to shift the releasing portion toward the holding portion and operative to come into contact with a contacting portion provided on the housing and move the engaging end portion thereof to approach to the root of the releasing portion connected with the shell member when the manipulatable part of the releasing portion is manipulated to shift the releasing portion toward the holding portion. The holding portion is, for example, further operative to cause a top end part of the engaging end portion thereof to be positioned at an inside of the opening through which the flat circuit device is inserted into the housing when the holding portion is restricted in its position by the positioning portion provided on the housing and then to cause the top end part of the engaging end portion thereof to go away from the inside of the opening through which the flat circuit device is inserted into the housing when the holding portion is operative to shift the engaging end portion thereof so as to approach to the root of the releasing portion connected with the shell member.

Accordingly, the holding portion is operative to cause the engaging end portion thereof to engage with the engaging portion provided on the flat circuit device inserted in the housing under a condition wherein the manipulatable part of the releasing portion is not manipulated to shift the releasing portion toward the holding portion and therefore the holding portion is in contact with the positioning portion provided on the housing so as to be restricted in its position by the positioning portion provided on the housing, and to cause the engaging end portion thereof to disengage from the engaging portion provided on the flat circuit device inserted in the housing under a condition wherein the manipulatable part of the releasing portion is manipulated to shift the releasing portion toward the holding portion and therefore the holding portion is kept in contact with the contacting portion provided on the housing and operative to shift the engaging end portion thereof to approach to the root of the releasing portion connected with the shell member.

Further, in the electrical connector according to the present invention, a position on the outside of the housing, at which the releasing portion of the shell member is put when the holding portion of the shell member is put in engagement with the flat circuit device inserted in the housing to hold the same, is different from a position on the outside of the housing, at which the releasing portion of the shell member is put when the holding portion of the shell member is released from the engagement with the flat circuit device inserted in the housing so as not to hold the same.

In addition, in an example of the electrical connector according to the present invention, a couple of sets of the holding portion and the releasing portion of the shell member are formed in a body respectively in a pair of portions of the shell member which cover the second pair of opposite end portions of the housing, respectively.

With the electrical connector constituted in accordance with the present invention, as described above, when the flat circuit device, such as the FPC, the FFC and so on, is inserted into the housing thorough the opening provided thereon, the contacting portion of each of the conductive contacts arranged on the housing comes into contact with the corresponding one of the connecting terminals provided on the flat circuit device inserted in the housing and the holding portion formed in a body in the shell member is put in engagement with the flat circuit device inserted in the housing for holding the same. As a result, the flat circuit device inserted in the housing is held by the holding portion of the shell member so as to be prevented from getting out of the housing unwillingly and the conductive contacts arranged on the housing are stably kept in electrical connection with the connecting terminals provided on the flat circuit device inserted in the housing.

Then, when the releasing portion formed in a body in the shell member in addition to the holding portion is manipulated to release the holding portion from the engagement with the flat circuit device inserted in the housing under a condition wherein the flat circuit device inserted in the housing is put in holding by the holding portion, the releasing portion is moved to shift the holding portion through the connecting portion so that the holding portion is released from the engagement with the flat circuit device. As a result, the flat circuit device inserted in the housing is released from the holding by the holding member so as to be able to get out of the housing.

Accordingly, with the electrical connector according to the present invention, the flat circuit device inserted in the housing can be put in the holding by the holding portion formed in a body in the shell member to be surely prevented from getting out of the housing unwillingly and then released from the holding by the holding portion to be able to get out of the housing with an improved structure with which the electrical connector can be miniaturized on the whole and the number of structural parts can be reduced.

In the electrical connector according to the present invention, since the U-shaped portion is constituted in the shell member with the releasing portion, the connecting portion and the holding portion, the holding portion can be shifted in its position on a relatively large scale through the connecting portion with a relatively small-scale movement of the releasing portion caused by the manipulation inflicted on the releasing portion. As a result, the flat circuit device inserted in the housing can be released from the holding by the holding portion with an improved structure in which the releasing portion, the connecting portion and the holding portion can be miniaturized on the whole.

Further, in the electrical connector thus constituted in accordance with the present invention, since the releasing portion formed in a body in the shell member extends from the portion of the shell member covering one of the second pair of opposite end portions of the housing to the outside of the housing on the side of one of the first pair of opposite end portions of the housing, the manipulation inflicted on the releasing portion for releasing the holding portion from the engagement with the flat circuit device inserted in the housing does not exert any substantial pressure on the solid circuit board on which the housing is mounted but exerts pressure on one of the second pair of opposite end portions of the housing. As a result, the flat circuit device inserted in the housing can be easily released from the holding by the holding portion formed in a body in the shell member without exerting undesirable coercive force on the solid circuit board with which the flat circuit device is connected electrically.

In addition, in the electrical connector constituted in accordance with the present invention, the position on the outside of the housing, at which the releasing portion of the shell member is put when the holding portion of the shell member is put in engagement with the flat circuit device inserted in the housing to hold the same, is different from the position on the outside of the housing, at which the releasing portion of the shell member is put when the holding portion of the shell member is released from the engagement with the flat circuit device inserted in the housing so as not to hold the same. Consequently, it can be easily, quickly and accurately confirmed by means of visual check or sentient check to the releasing portion from the outside of the electrical connector that the flat circuit device inserted in the housing has reached the appropriate position in the housing to be surely prevented from getting out of the housing unwillingly by the holding portion formed in a body in the shell member.

The above, and other objects, features and advantages of the present invention will become apparent from the following detailed description taken in conjunction with the accompanying drawings.

DETAILED DESCRIPTION OF THE INVENTION

Figure 1:
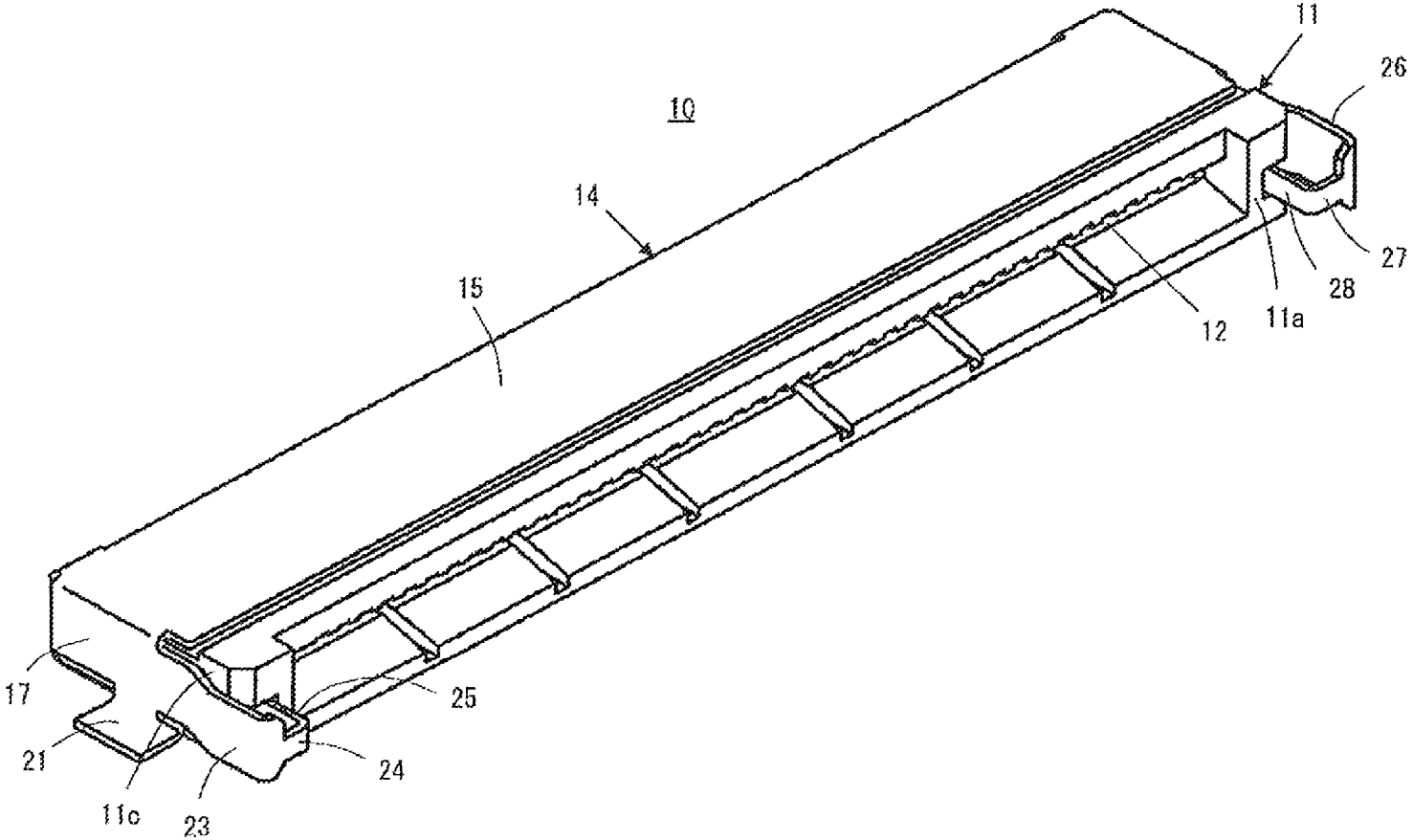
FIG. 1 is a schematic front, top and left side perspective view showing an embodiment of electrical connector according to the present invention.
Figure 2:
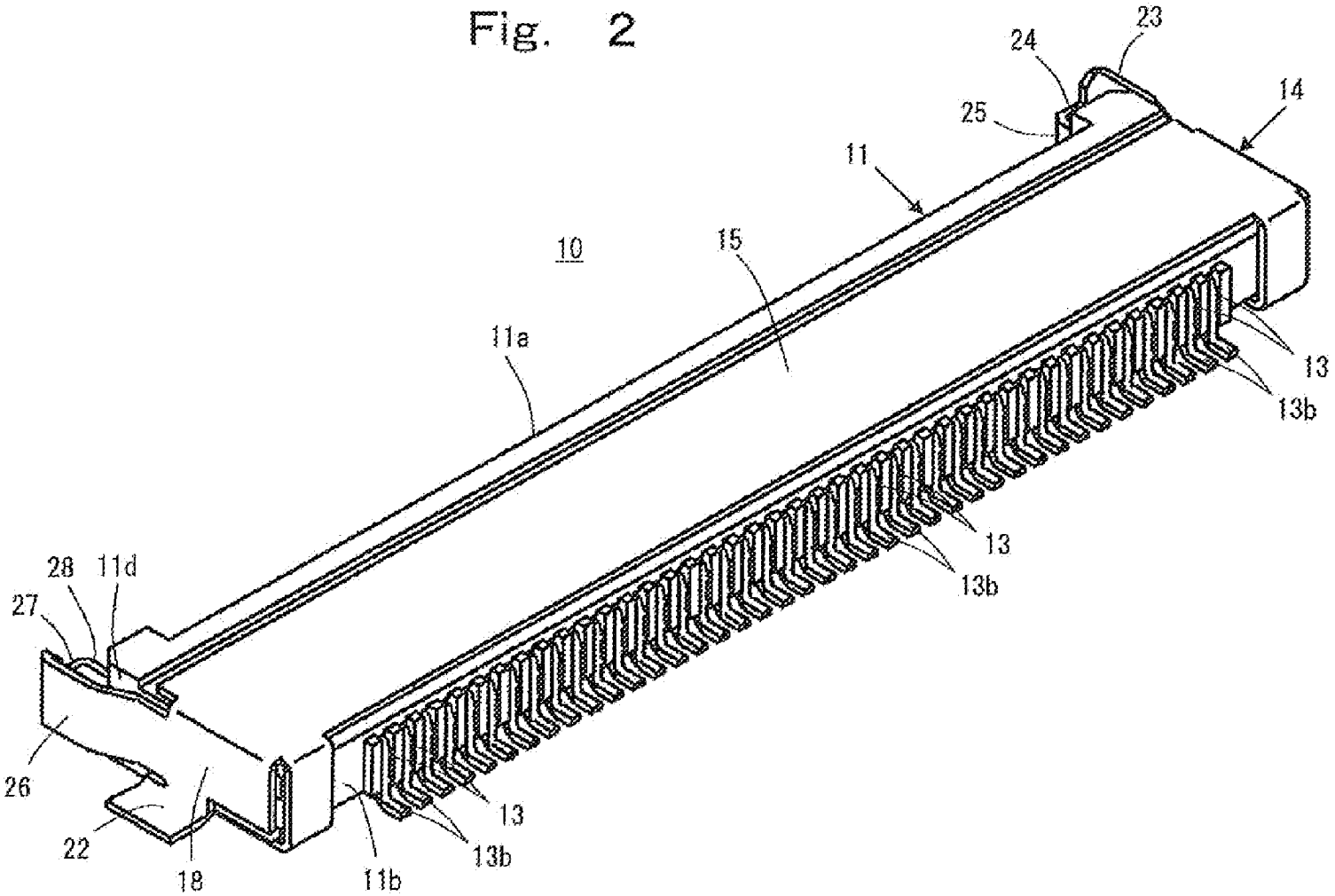
FIG. 2 is a schematic rear, top and left side perspective view showing the embodiment shown in FIG. 1.
Figure 3:
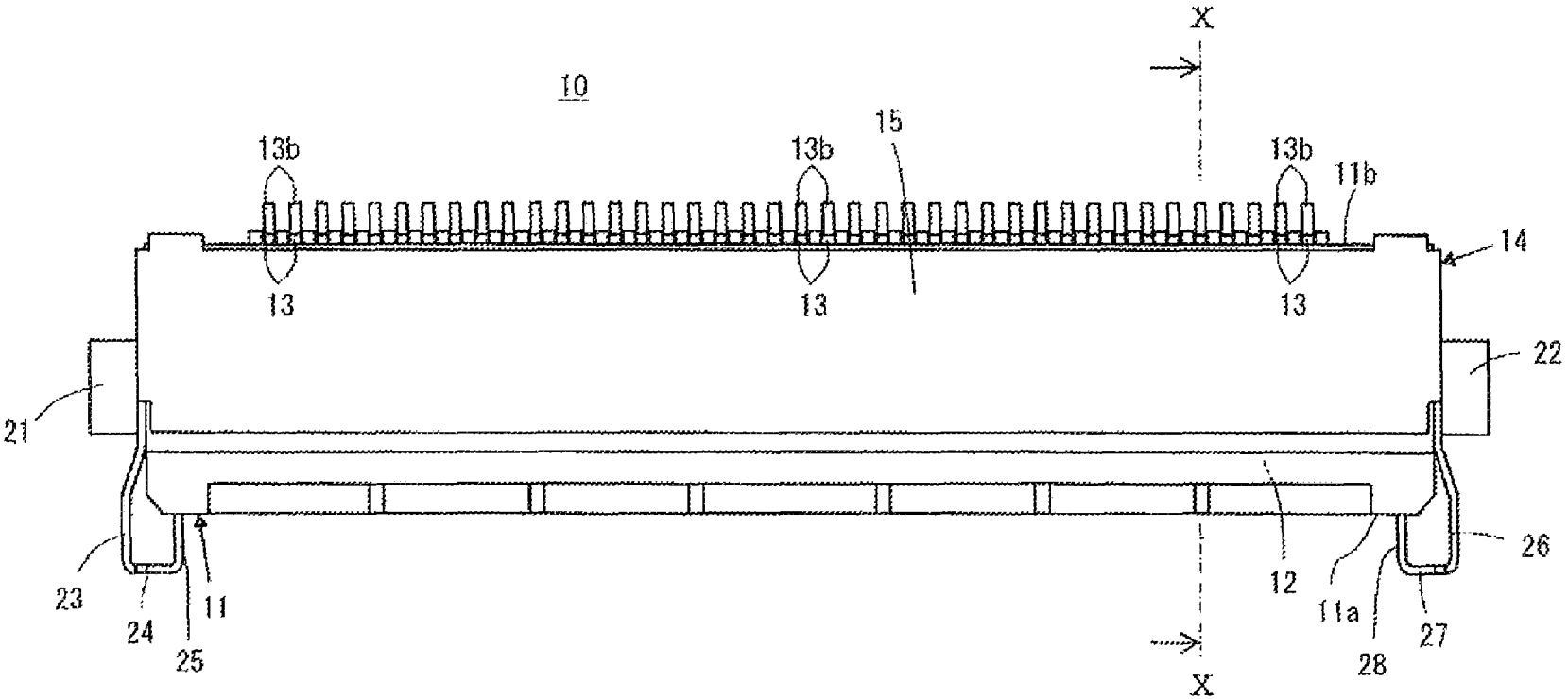
FIG. 3 is a schematic plan view showing the embodiment shown in each of FIGS. 1 and 2.
Figure 4:
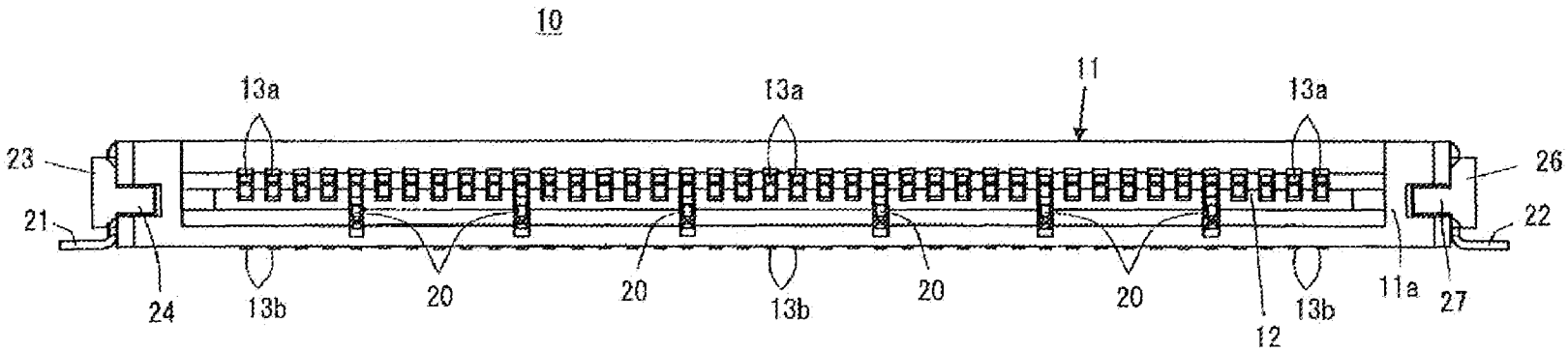
FIG. 4 is a schematic front view showing the embodiment shown in each of FIGS. 1 and 2.
Figure 5:
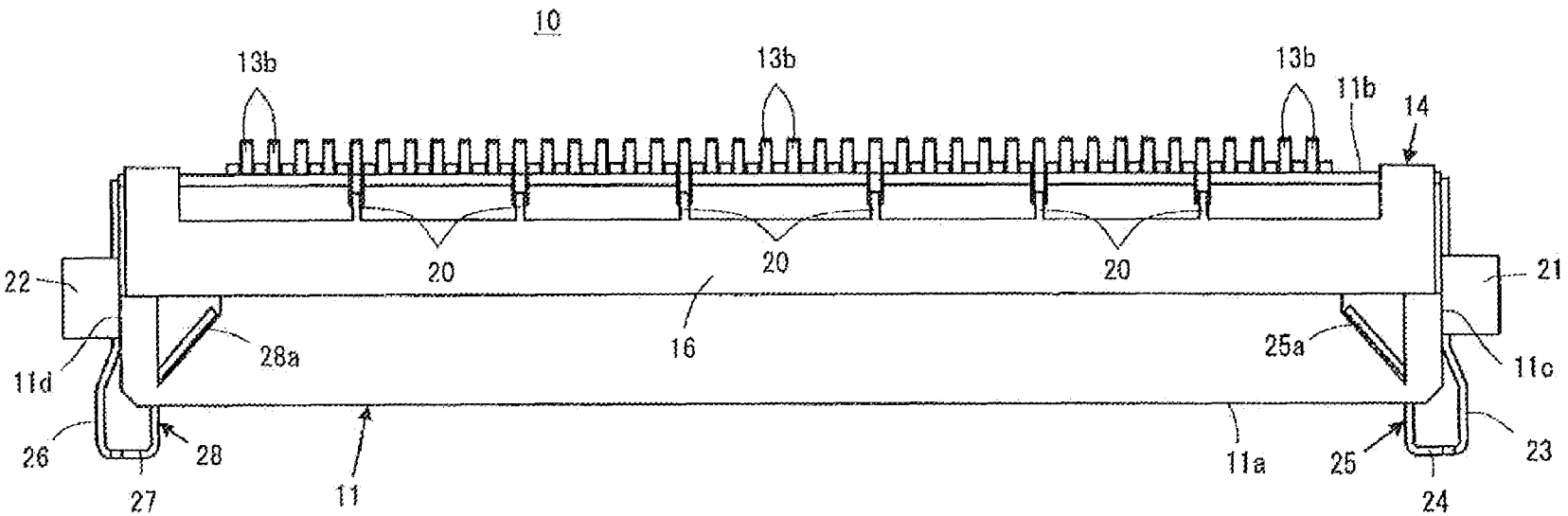
FIG. 5 is a schematic bottom view showing the embodiment shown in each of FIGS. 1 and 2.

Each of FIG. 1 which is a schematic front, top and left side perspective view, FIG. 2 which is a schematic rear, top and left side perspective view, FIG. 3 which is a schematic plan view, FIG. 4 which is a schematic front view and FIG. 5 which is a schematic bottom view, shows an embodiment of electrical connector according to the present invention.

Referring to FIGS. 1 to 5, an electrical connector 10, which constitutes the embodiment of electrical connector according to the present invention, has a housing 11 made of, for example, insulator such as plastics or the like. The housing 11 has a front end portion 11*a* and a rear end portion 11*b* which constitute a first pair of opposite end portions of the housing 11, and a left end portion 11*c* and a right end portion 11*d* which constitute a second pair of opposite end portions of the housing 11. Further, the housing 11 is provided thereon with an opening 12 which opens on the front end portion 11*a* of the housing 11 and extends from the front end portion 11*a* of the housing 11 through an inside of the housing 11 toward the rear end portion 11*b* of the housing. When the electrical connector 10 is put in practical use, the housing 11 is mounted on a solid circuit board in an electronic apparatus (not shown in the drawings) with a bottom end portion thereof facing the solid circuit board so that the electrical connector 10 is fixed in its entirety to the solid circuit board. For example, an FPC constituting a flat circuit device as explained later is inserted through the opening 12 into the housing 11 which is mounted on the solid circuit board.

Figure 10:
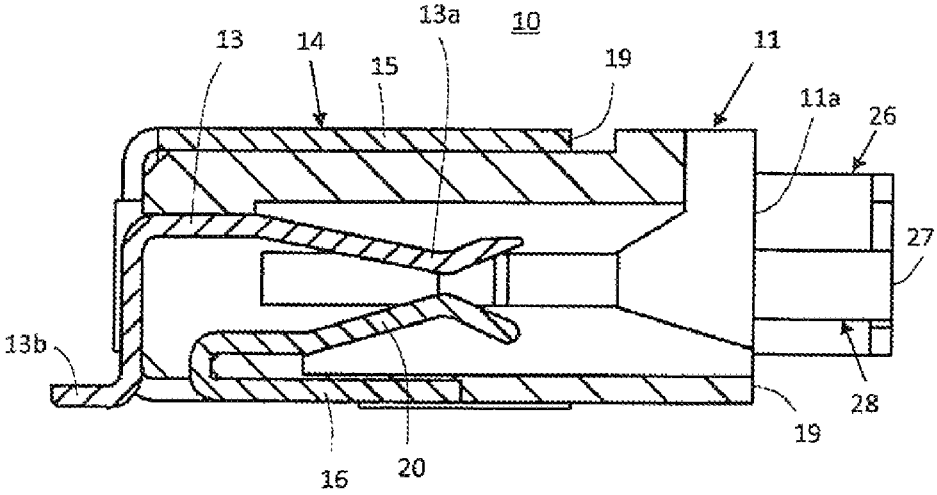
FIG. 10 is a schematic cross sectional view taken along line X-X on FIG. 3.

A plurality of conductive contacts 13, each of which is made of resilient conductive material, are provided on the housing 11 of the electrical connector 10 to be arranged in a longitudinal direction of the housing 11. Each of the conductive contacts 13 constitutes, for example, a contacting portion 13*a* positioned in the housing 11 and a connecting terminal portion 13*b* projecting from the rear end portion 11*b* of the housing 11 to the outside of the housing 11, as shown in FIG. 4 and FIG. 10 which is the schematic cross sectional view taken along line X-X on FIG. 3. The contacting portion 13*a* of the conductive contact 13 is operative to come into contact with a corresponding one of connecting terminals provided on the FPC inserted in the housing 11 from the side of a top end portion opposite to the bottom end portion of the housing 11 so as to be electrically connected with the same, and the connecting terminal portion 13*b* of the conductive contact 13 is operative to be electrically connected with a signal terminal provided on the solid circuit board on which the housing 11 is mounted, for example, by means of soldering. Thereby, the connecting terminals provided on the FPC inserted in the housing 11 are electrically connected through the conductive contacts 13 with the signal terminals provided on the solid circuit board on which the housing 11 is mounted.

The electrical connector 10 has also a shell member 14 mounted on the housing 11 for covering an outer surface of the housing 11 except the front end portion 11*a* surrounding the opening 12, a major part of the rear end portion 11*b*, and a part of the bottom end portion of the housing 11. That is, the shell member 14 is provided for covering partially the housing 11 and a major part of each of the left and right end portions 11*c* and 11*d* of the housing 11 is covered by the shell member 14.

The shell member 14 is formed by means of processing a resilient metal thin plate and grounded to be operative to contribute to adjustment on characteristic impedance of each of the conductive contacts 13 and to shield the conductive contacts 13 arranged on the housing 11 from electromagnetic wave noises coming from the outside.

Figure 6:
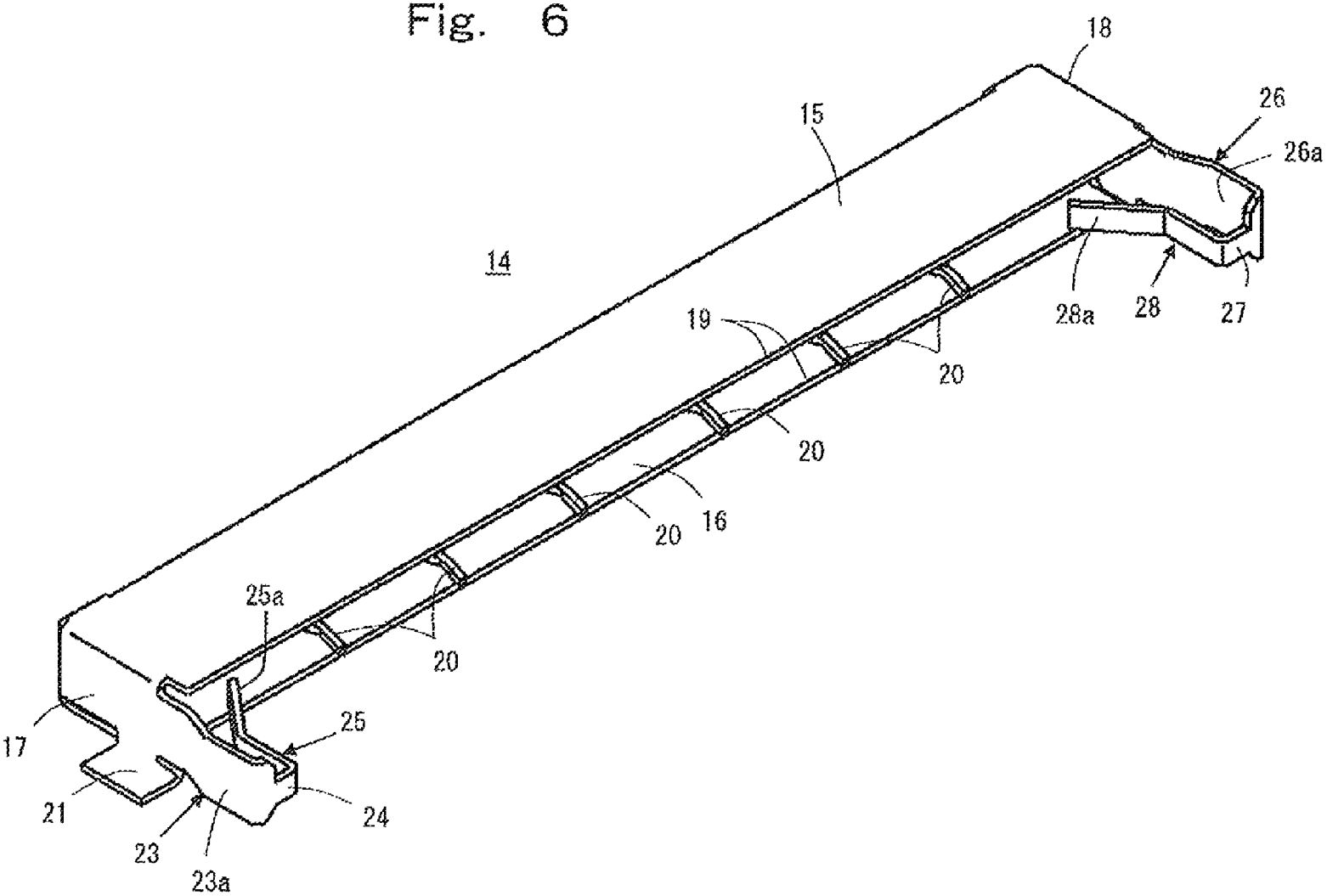
FIG. 6 is a schematic front, top and left side perspective view showing a shell member provided to be employed in the embodiment shown in each of FIGS. 1 and 2.
Figure 7:
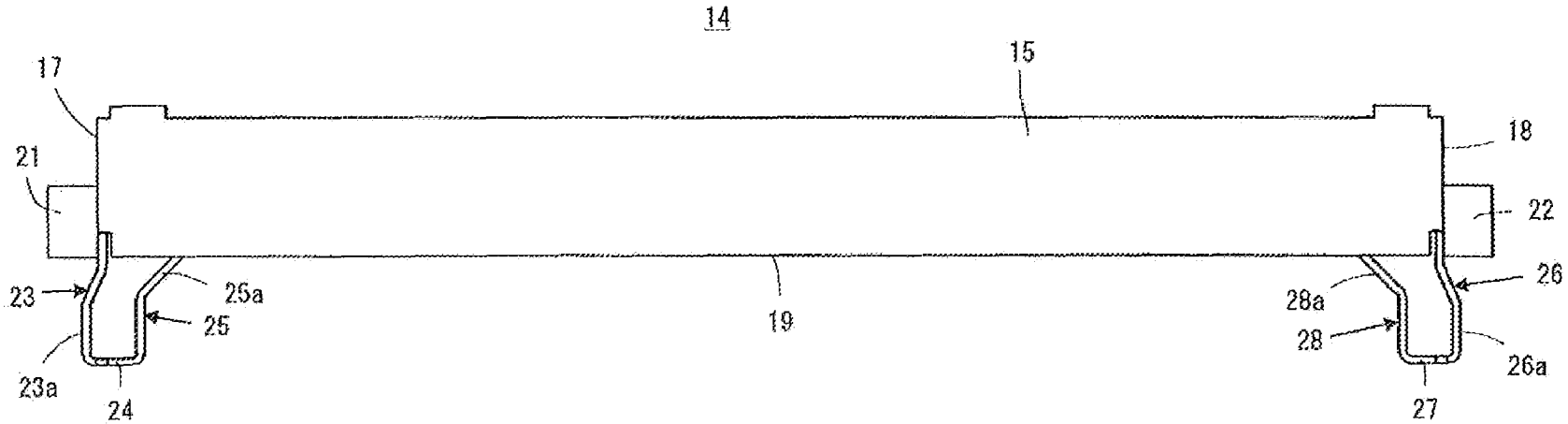
FIG. 7 is a schematic plan view showing the shell member provided to be employed in the embodiment shown in each of FIGS. 1 and 2.
Figure 8:
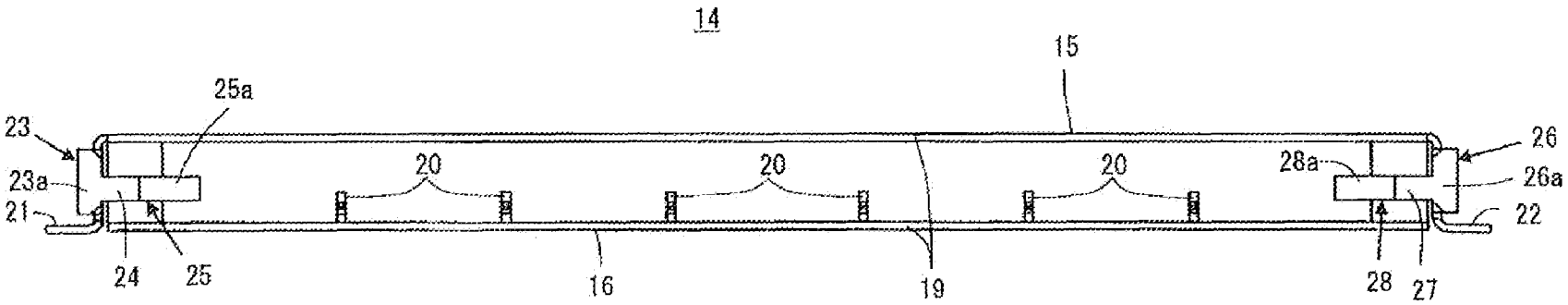
FIG. 8 is a schematic front view showing the shell member provided to be employed in the embodiment shown in each of FIGS. 1 and 2.
Figure 9:
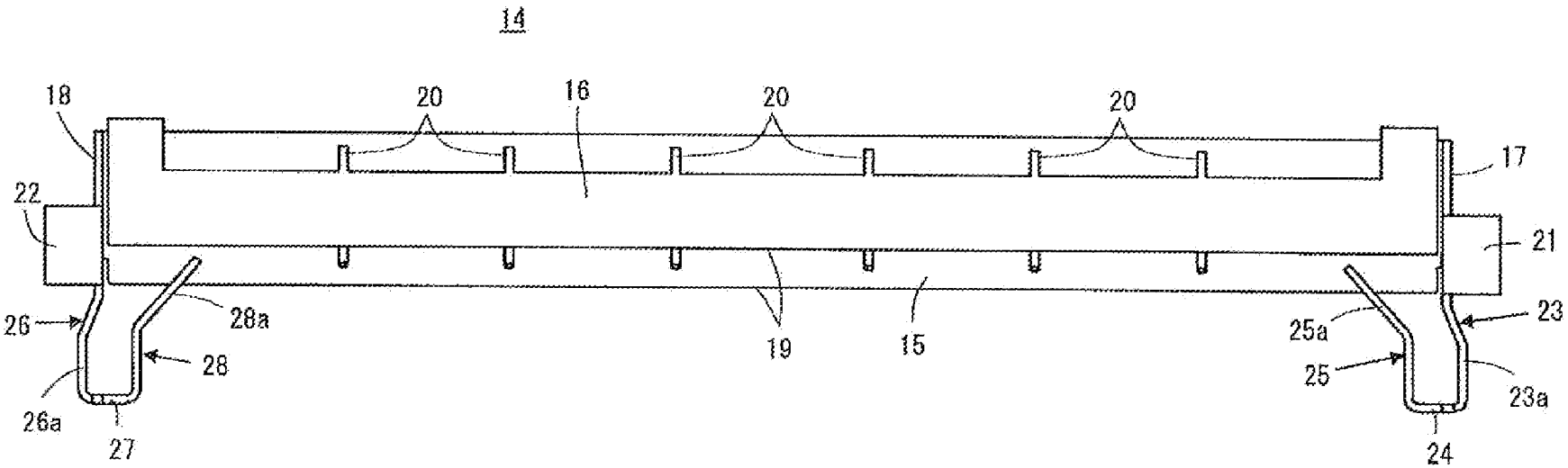
FIG. 9 is a schematic bottom view showing the shell member provided to be employed in the embodiment shown in each of FIGS. 1 and 2.

As shown in FIG. 6 which is a schematic front, bottom and left side perspective view showing the shell member 14, FIG. 7 which is a schematic plan view showing the shell member 14, FIG. 8 which is a schematic front view showing the shell member 14 and FIG. 9 which is a schematic bottom view showing the shell member 14, the shell member 14 is provided with an upper portion 15 for covering a major part of the top end portion of the housing 11, a lower portion 16 for covering a part of the bottom end portion of the housing 11, a left side portion 17 for covering the major part of the left end portion 11*c* of the housing 11, a right side portion 18 for covering the major part of the right end portion 11*d* of the housing 11, and a front portion 19 for forming an opening.

The lower portion 16 of the shell member 14 is provided with a plurality of grounding contacts 20, each of which extends from a rear end portion opposite to the front portion 19 of the shell member 14 to be bent into an inside of the shell member 14 toward the front portion 19 of the shell member 14, as shown in FIG. 10. Each of the grounding contacts 20 is operative to come into contact with a ground connecting terminal provided on the FPC inserted in the housing 11 through the opening 12 provided thereon from the side of the lower portion 16 of the shell member 14. The left and the right side portions 17 and 18 of the shell member 14 are provided with board connecting portions 21 and 22, respectively. Each of the board connecting portions 21 and 22 is electrically connected with grounded portion provided on the solid circuit board on which the housing 11 is mounted, for example, by means of soldering.

With the grounding contacts 20 and the board connecting portions 21 and 22 thus provided on the shell member 14, the ground connecting terminals provided on the FPC inserted in the housing 11 are electrically connected through the shell member 14 with the grounded portion provided on the solid circuit board on which the housing 11 is mounted. Each of the board connecting portions 21 and 22 is operative to supply the shell member 14 with a ground potential from the solid circuit board and to be used for mounting the housing 11 on the solid circuit board.

As shown clearly in FIG. 6, the shell member 14 is also provided at a left side portion thereof with a holding portion 25 which is operative to be put in engagement with the FPC inserted in the housing 11 for holding the same, a releasing portion 23 which is operative to release the holding portion 25 from the engagement with the FPC inserted in the housing 11 when the releasing portion 23 is manipulated in a predetermined manner, and a connecting portion 24 for connecting the releasing portion 23 with the holding portion 25. Each of the releasing portion 23, the connecting portion 24 and the holding portion 25 is formed in a body in the shell member 14.

The releasing portion 23 extends from the left side portion 17 of the shell member 14 for covering the left end portion 11*c* of the housing 11 to the outside of the shell member 14 on the side of the front portion 19 of the shell member 14. The connecting portion 24 extends to be bent from a top end of the releasing portion 23 toward the right side portion 18 of the shell member 14. The holding portion 25 extends to be bent from a top end the connecting portion 24 toward the front portion 19 of the shell member 14. A U-shaped portion is constituted in the shell member 14 with the releasing portion 23, the connecting portion 24 and the holding portion 25

The shell member 14 is further provided at the right side portion 18 thereof with a holding portion 28 which is operative to be put in engagement with the FPC inserted in the housing 11 for holding the same, a releasing portion 26 which is operative to release the holding portion 28 from the engagement with the FPC inserted in the housing 11 when the releasing portion 26 is manipulated in a predetermined manner, and a connecting portion 27 for connecting the releasing portion 26 with the holding portion 28. Each of the releasing portion 26, the connecting portion 27 and the holding portion 28 is formed in a body in the shell member 14.

The releasing portion 26 extends from the right side portion 18 of the shell member 14 for covering the right end portion 11*d* of the housing 11 to the outside of the shell member 14 on the side of the front portion 19 of the shell member 14. The connecting portion 27 extends to be bent from a top end of the releasing portion 26 toward the left side portion 17 of the shell member 14. The holding portion 28 extends to be bent from a top end the connecting portion 27 toward the front portion 19 of the shell member 14. A U-shaped portion is constituted in the shell member 14 with the releasing portion 26, the connecting portion 27 and the holding portion 28.

Each of the holding portion 25 and the holding portion 28 formed in a body in the shell member 14 which is formed by means of processing the resilient metal thin plate, constitutes a resilient movable arm-shaped portion. The holding portion 25 is provided thereon with an engaging end portion 25*a* for engaging with an engaging portion provided on the FPC inserted in the housing 11 and operative to swing with a fulcrum placed at a root of the holding portion 25 connected with the connecting portion 24. Similarly, the holding portion 28 is provided thereon with an engaging end portion 28*a* for engaging with an engaging portion provided on the FPC inserted in the housing 11 and operative to swing with a fulcrum placed at a root of the holding portion 28 connected with the connecting portion 27.

The releasing portion 23 is provided thereon with a manipulatable part 23*a* on which manipulation for shifting the releasing portion 23 toward the holding portion 25 is exerted and operative to swing with a fulcrum placed at a root of the releasing portion 23 connected with the left side portion 17 of the shell member 14. Similarly, the releasing portion 26 is provided thereon with a manipulatable part 26*a* on which manipulation for shifting the releasing portion 26 toward the holding portion 28 is exerted and operative to swing with a fulcrum placed at a root of the releasing portion 26 connected with the right side portion 18 of the shell member 14.

Figure 11:
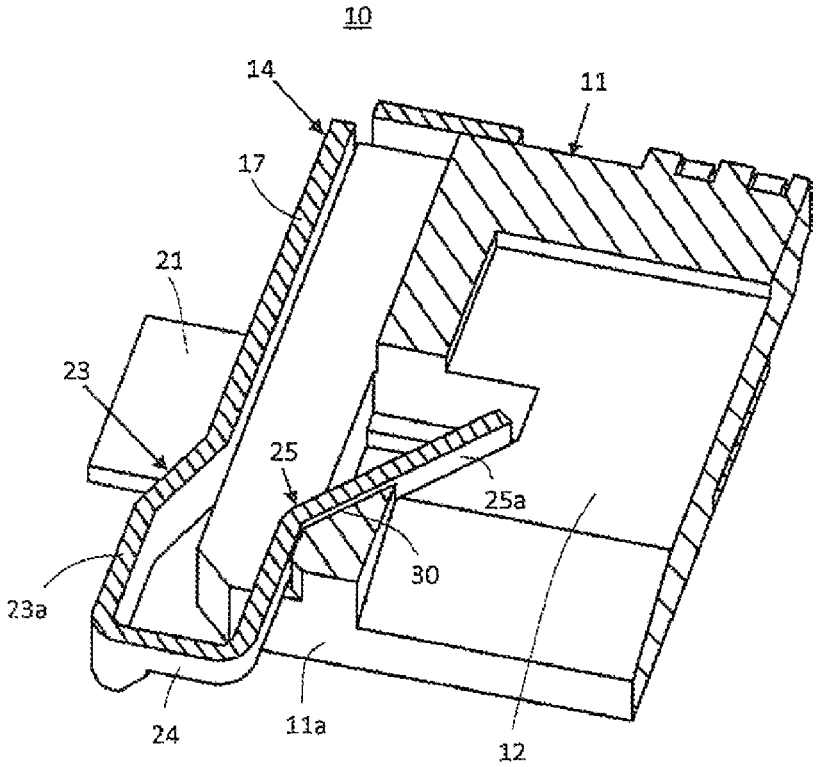
FIG. 11 is a schematic partial perspective view including a partial cross section and used for explaining a holding portion, a connecting portion and a releasing portion employer in the embodiment shown in each of FIGS. 1 and 2.

As shown in FIG. 11 which shows a schematic partial cross section of a right end portion of the electrical connector 10, the holding portion 25 is operative to come into contact with a positioning portion 30 provided on the housing 11 to be restricted in its position thereby and to cause a top end part of the engaging end portion 25*a* thereof to be positioned at an inside of the opening 12 provided on the housing 11 when the manipulatable part 23*a* of the releasing portion 23 is not manipulated to shift the releasing portion 23 toward the holding portion 25. When the FPC is inserted into the housing 11 under a condition wherein the top end part of the engaging end portion 25*a* of the holding portion 25 is positioned at the inside of the opening 12 provided on the housing 11 in such a manner as mentioned above, the holding portion 25 causes the top end part of the engaging end portion 25*a* thereof to engage with an engaging portion provided on the FPC so that the FPC is held by the holding portion 25.

Figure 12:
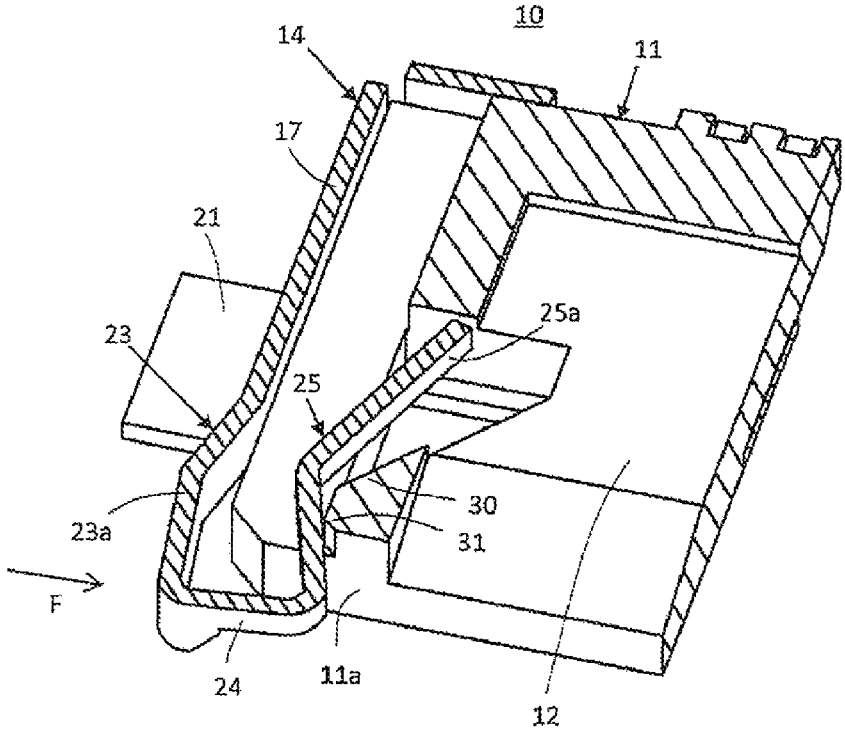
FIG. 12 is a schematic partial perspective view including partial cross sections and used for explaining the holding portion, the connecting portion and the releasing portion employer in the embodiment shown in each of FIGS. 1 and 2.

Then, as shown in FIG. 12 which shows also a schematic partial cross section of the right end portion 11*d* of the electrical connector 10, when the manipulatable part 23*a* of the releasing portion 23 is manipulated with pressure exerted thereon in a direction to the holding portion 25 as shown with an arrow F in FIG. 12 to shift the releasing portion 23 toward the holding portion 25, the releasing portion 23 is moved to swing with the fulcrum placed at the root of the releasing portion 23 connected with the left side portion 17 of the shell member 14. Thereby, the holding portion 25 is caused to come into contact with a contacting portion 31 provided on the housing 11 and to swing with the fulcrum placed at the root of the holding portion 25 connected with the connecting portion 24 so that the engaging end portion 25*a* of the holding portion 25 is moved to approach to the root of the releasing portion 23 connected with the left side portion 17 of the shell member 14 and the top end part of the engaging end portion 25*a* of the holding portion 25 is caused to go away from the inside of the opening 12 provided on the housing 11. Under a condition wherein the top end part of the engaging end portion 25*a* of the holding portion 25 is caused to go away from the inside of the opening 12 provided on the housing 11 in such a manner as mentioned above, the top end part of the engaging end portion 25*a* of the holding portion 25 is disengaged from the engaging portion provided on the FPC inserted in the housing 11. Accordingly, the FPC inserted in the housing 11 is released from holding by the holding portion 25 when the manipulatable part 23*a* of the releasing portion 23 is manipulated with the pressure exerted thereon in the direction to the holding portion 25 under the condition wherein the FPC is held by the holding portion 25.

Similarly, the holding portion 28 is also operative to come into contact with a positioning portion corresponding to the positioning portion 30 provided on the housing 11 to be restricted in its position thereby and to cause a top end part of the engaging end portion 28*a* thereof to be positioned at the inside of the opening 12 provided on the housing 11 when the manipulatable part 26*a* of the releasing portion 26 is not manipulated to shift the releasing portion 26 toward the holding portion 28. When the FPC is inserted into the housing 11 under a condition wherein the top end part of the engaging end portion 28*a* of the holding portion 28 is positioned at the inside of the opening 12 provided on the housing 11 in such a manner as mentioned above, the holding portion 28 causes the top end part of the engaging end portion 28*a* thereof to engage with an engaging portion provided on the FPC so that the FPC is held by the holding portion 28.

Then, when the manipulatable part 26*a* of the releasing portion 26 is manipulated with pressure exerted thereon in a direction to the holding portion 28 to shift the releasing portion 26 toward the holding portion 28, the releasing portion 26 is moved to swing with the fulcrum placed at the root of the releasing portion 26 connected with the right side portion 18 of the shell member 14. Thereby, the holding portion 28 is caused to come into contact with a contacting portion corresponding to the contacting portion 31 provided on the housing 11 and to swing with the fulcrum placed at the root of the holding portion 28 connected with the connecting portion 27 so that the engaging end portion 28*a* of the holding portion 28 is moved to approach to the root of the releasing portion 26 connected with the right side portion 18 of the shell member 14 and the top end part of the engaging end portion 28*a* of the holding portion 28 is caused to go away from the inside of the opening 12 provided on the housing 11. Under a condition wherein the top end part of the engaging end portion 28*a* of the holding portion 28 is caused to go away from the inside of the opening 12 provided on the housing 11 in such a manner as mentioned above, the top end part of the engaging end portion 28*a* of the holding portion 28 is disengaged from the engaging portion provided on the FPC inserted in the housing 11. Accordingly, the FPC inserted in the housing 11 is released from holding by the holding portion 28 when the manipulatable part 26*a* of the releasing portion 26 is manipulated with the pressure exerted thereon in the direction to the holding portion 28 under the condition wherein the FPC is held by the holding portion 28.

Figure 13:
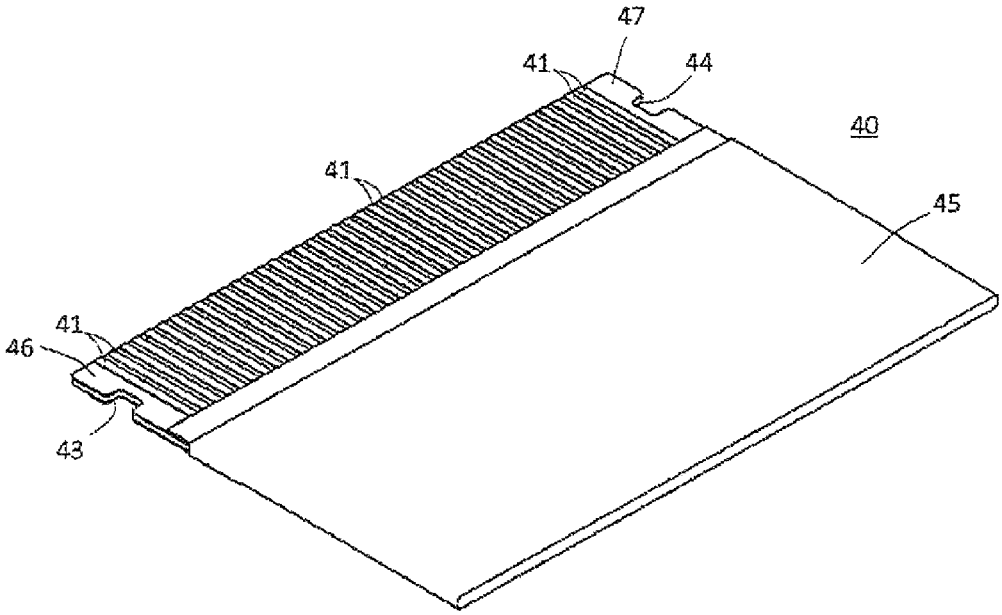
FIG. 13 is a schematic perspective view showing an FPC which is to be inserted into a housing of the embodiment shown in each of FIGS. 1 and 2.

FIG. 13 shows an FPC 40 which is an example of the FPC constituting the flat circuit device to be inserted into the housing 11 of the electrical connector 10 through the opening 12 provided on the housing 11.

Referring to FIG. 10, a plurality of signal connecting terminals 41 each made of conductive material and formed into a rectangular plate member are provided on a first surface opposite to a second surface of the FPC 40 to be arranged at a top end portion of the first surface. Although an illustrative explanation is omitted, a ground connecting flat portion is also provided on the second surface of the FPC 40. Further, a pair of engaging edged recesses 43 and 44 are provided respectively on side end portions of the FPC 40 which are opposite each other with the signal connecting terminals 41 between. A top flat portion 46 is formed at the outside of the engaging edged recess 43 provided on one of the side end portions of the FPC 40 and another top flat portion 47 is formed at the outside of the engaging edged recess 44 provided on the other of the side end portions of the FPC 40.

It is possible to provide the FPC 40 with a pair of engaging edged holes in place of the engaging edged recesses 43 and 44. The FPC 40 is wrapped with a covering film 45 except a portion thereof on which the signal connecting terminals 41, the ground connecting flat portion, the engaging edged recesses 43 and 44 and the top flat portions 46 and 47 are provided.

Figure 14:
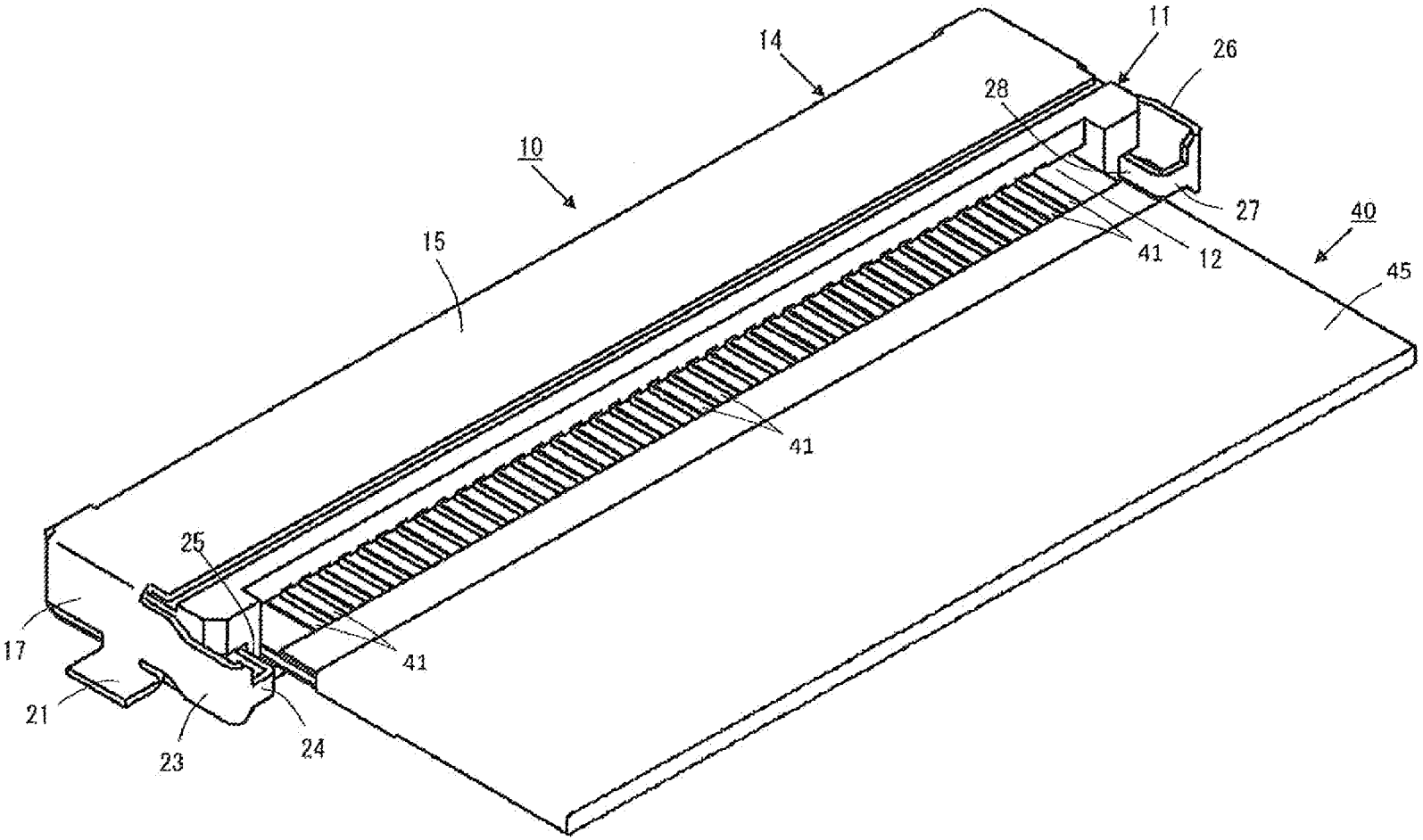
FIG. 14 is a schematic perspective view showing a situation wherein the FPC has been inserted in the embodiment shown in each of FIGS. 1 and 2.

FIG. 14 shows the electrical connector 10 and the FPC 40 which is inserted in the housing 11 of the electrical connector 10 through the opening 12 provided on the housing 11. In FIG. 14, the first surface of the FPC 40, on which the signal connecting terminals 41 are provided, faces upward to appear on the side of the upper portion 15 of the shell member 14, and the second surface of the FPC 40, on which the ground connecting flat portion is provided, faces upward to be not shown. A top end of a part of the FPC 40 on which the signal connecting terminal 41 are provided is postured to be parallel with the rear end portion 11*b* of the housing 11 in a condition wherein the FPC 40 is properly inserted into the housing 11 through the opening 12 provided on the housing 11.

Figure 15:
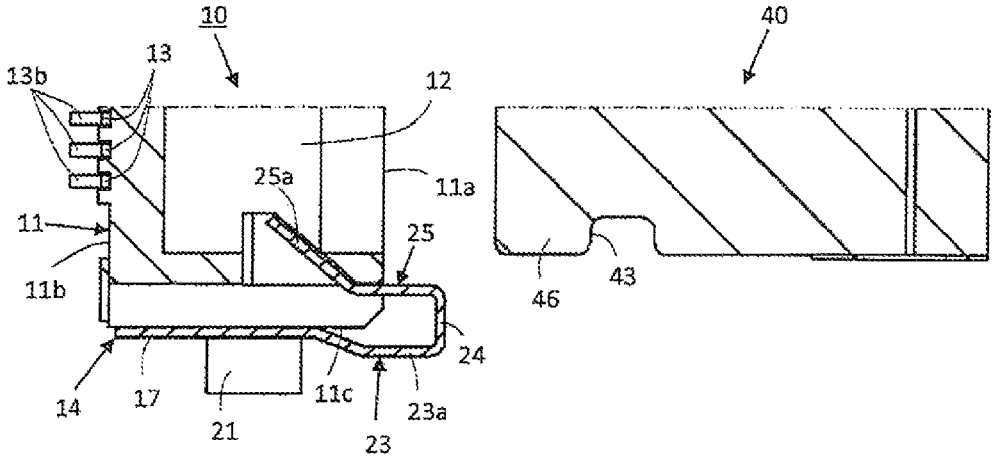
FIG. 15 is a schematic partial cross sectional view showing a situation wherein the FPC is positioned to be inserted into the embodiment shown in each of FIGS. 1 and 2.

When the FPC 40 is inserted in the housing 11 of the electrical connector 10 through the opening 12 provided on the housing 11 as shown in FIG. 14, first the top end of the part of the FPC 40 on which the signal connecting terminal 41 are provided is placed to face the opening 12 provided on the front end portion 11*a* of the housing 11 of the electrical connector 10 under the condition wherein the manipulatable part 26*a* of the releasing portion 26 is not manipulated with the pressure exerted thereon, as shown in FIG. 15. On that occasion, the top flat portion 46 and the engaging edged recess 43 of the FPC 40 are positioned to correspond to the holding portion 25 of the electrical connector 10 in such a manner as shown in FIG. 15 and the top flat portion 47 and the engaging edged recess 44 of the FPC 40 are positioned to correspond to the holding portion 28 of the electrical connector 10.

Figure 16:
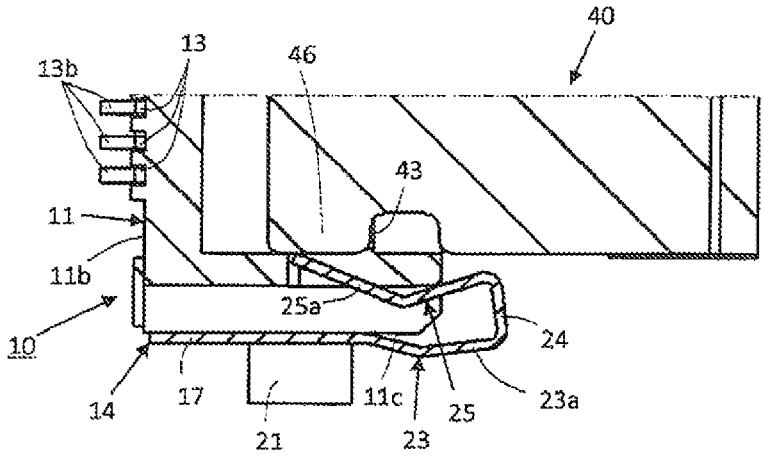
FIG. 16 is a schematic partial cross sectional view showing a situation wherein the FPC is on the way to complete insertion into the embodiment shown in each of FIGS. 1 and 2.

Then, the FPC 40 is inserted into the housing 11 through the opening 12 provided on the front end portion 11*a* of the housing 11 with the top end thereof facing the rear end portion 11*b* of the housing 11. With the FPC 40 inserted continuously into the housing 11, the top flat portion 46 formed at the outside of the engaging edged recess 43 of the FPC 40 comes into contact with the engaging end portion 25*a* of the holding portion 25 and thereby causes the holding portion 25 to swing with fulcrum placed at the root of the holding portion 25 connected with the connecting portion 24 so that the engaging end portion 25*a* of the holding portion 25 is moved to approach to the root of the releasing portion 23 connected with the left side portion 17 of the shell member 14. As a result, the top end part of the engaging end portion 25*a* of the holding portion 25 is caused to go away from the inside of the opening 12 provided on the housing 11 and to come into contact with a side end surface of the top flat portion 46 of the FPC 40, as shown in FIG. 16, so that the FPC 40 inserted continuously into the housing 11 is not disturbed by the holding portion 25.

Further, the top flat portion 47 formed at the outside of the engaging edged recess 44 of the FPC 40 also comes into contact with the engaging end portion 28*a* of the holding portion 28 and thereby causes the holding portion 28 to swing with fulcrum placed at the root of the holding portion 28 connected with the connecting portion 27 so that the engaging end portion 28*a* of the holding portion 28 is moved to approach to the root of the releasing portion 26 connected with the right side portion 18 of the shell member 14. As a result, although an illustrative explanation is omitted, the top end part of the engaging end portion 28*a* of the holding portion 28 is caused to go away from the inside of the opening 12 provided on the housing 11 and to come into contact with a side end surface of the top flat portion 47 of the FPC 40, so that the FPC 40 inserted continuously into the housing 11 is not disturbed by the holding portion 28.

When the top end part of the engaging end portion 25*a* of the holding portion 25 is in contact with the side end surface of the top flat portion 46 of the FPC 40 and the top end part of the engaging end portion 28*a* of the holding portion 28 is in contact with the side end surface of the top flat portion 47 of the FPC 40 in such a manner as mentioned above, the releasing portion 23 is placed at a position where the releasing portion 23 manipulated with the pressure exerted thereon in the direction to the holding portion 25 is placed and the releasing portion 26 is placed at a position where the releasing portion 26 manipulated with the pressure exerted thereon in the direction to the holding portion 28 is placed.

After that, the FPC 40 is further inserted into the housing 11 to reach a predetermined appropriate position in the housing 11. When the FPC 40 has reached the predetermined appropriate position in the housing 11, the insertion of the FPC 40 into the housing 11 is completed.

Figure 17:
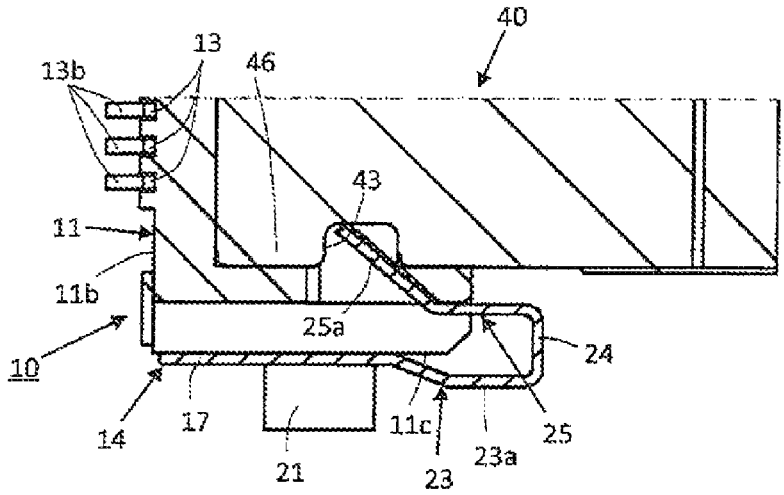
FIG. 17 is a schematic partial cross sectional view showing a situation wherein the FPC has been correctly inserted into the embodiment shown in each of FIGS. 1 and 2 to be held by the holding portion of the shell member employed in the embodiment shown in each of FIGS. 1 and 2.

When the FPC 40 is completely inserted into the housing 11, the top end part of the engaging end portion 25*a* of the holding portion 25 gets out of the contact with the top flat portion 46 of the FPC 40 and thereby engages with the engaging edged recess 43 provided on the FPC 40, as shown in FIG. 17. Further, the top end part of the engaging end portion 28*a* of the holding portion 28 also gets out of the contact with the top flat portion 47 of the FPC 40 and thereby engages with the engaging edged recess 44 provided on the FPC 40.

On that occasion, the holding portion 25 is caused by its own restoring resilient force to swing with the fulcrum placed at the root of the holding portion 25 connected with the connecting portion 24 for getting back to its condition prior to the movement to approach to the root of the releasing portion 23 and operative to cause the top end part of the engaging end portion 25*a* thereof to engage with the engaging edged recess 43 provided on the FPC 40. Similarly, the holding portion 28 is caused by its own restoring resilient force to swing with the fulcrum placed at the root of the holding portion 28 connected with the connecting portion 27 for getting back to its condition prior to the movement to approach to the root of the releasing portion 26 and operative to cause the top end part of the engaging end portion 28*a* thereof to engage with the engaging edged recess 44 provided on the FPC 40. Thereby, the releasing portion 23 returns to the position where the manipulatable part 23*a* of the releasing portion 23 without being manipulated with the pressure exerted thereon is put and the releasing portion 26 returns to the position where the manipulatable part 26*a* of the releasing portion 26 without being manipulated with the pressure exerted thereon is put.

As a result, the holding portions 25 and 28 are put in engagement with the FPC 40 inserted in the housing 11 for holding the same, so that the FPC 40 is prevented from getting out of the housing 11 unwillingly.

Under the condition wherein the FPC 40 is inserted in the housing 11 through the opening 12 provided thereon as described above, a position on the outside of the housing 11, at which the releasing portion 23 is put when the top end part of the engaging end portion 25*a* the holding portion 25 is put in engagement with the engaging edged recess 43 provided on the FPC 40 inserted in the housing 11 to hold the FPC, is different from a position on the outside of the housing 11, at which the releasing portion 23 is put when the top end part of the engaging end portion 25*a* the holding portion 25 is released from the engagement with the engaging edged recess 43 provided on the FPC 40 inserted in the housing 11 so as not to hold the FPC 40. Similarly, a position on the outside of the housing 11, at which the releasing portion 26 is put when the top end part of the engaging end portion 28*a* the holding portion 28 is put in engagement with the engaging edged recess 44 provided on the FPC 40 inserted in the housing 11 to hold the FPC 40, is different from a position on the outside of the housing 11, at which the releasing portion 26 is put when the top end part of the engaging end portion 28*a*, the holding portion 28 is released from the engagement with the engaging edged recess 44 provided on the FPC 40 inserted in the housing 11 so as not to hold the FPC 40. Consequently, it can be easily, quickly and accurately confirmed by means of checking visually or sentiently the position of each of the releasing portions 23 and 26 from the outside of the electrical connector 10 that the FPC 40 inserted in the housing 11 has reached the appropriate position in the housing 11 and is appropriately held by each of the holding portions 25 and 28 to be surely prevented from getting out of the housing 11 unwillingly.

Under a condition wherein the FPC 40 inserted in the housing 11 through the opening 12 provided thereon takes up the predetermined appropriate position in the housing 11 so as to be held by each of the holding portions 25 and 28 in such a manner as described above, each of the conductive contacts 13 arranged on the housing 11 comes into press-contact with a corresponding one of the signal connecting terminals 41 provided on the FPC 40, which is inserted in the housing 11 with the first surfaces thereof provided thereon with the signal connecting terminals 41 facing downward, from the side of the upper portion 15 of the shell member 14. As a result, the signal connecting terminals 41 provided on the FPC 40 inserted in the housing 11 are electrically connected through the conductive contacts 13 with the signal terminals provided on the solid circuit board on which the housing 11 is mounted.

Further, each of the grounding contacts 20 extending from the rear end portion 11*b* of the shell member 14 to be bent into the inside of the shell member 14 comes into contact with the ground connecting flat portion provided on the second surface of the FPC 40 inserted in the housing 11 from the side of the lower portion 16 of the shell member 14. As a result, the ground connecting flat portion provided on the FPC 40 inserted in the housing 11 is electrically connected through the grounding contacts 20 with the grounded portion provided on the solid circuit board on which the housing 11 is mounted.

Figure 18:
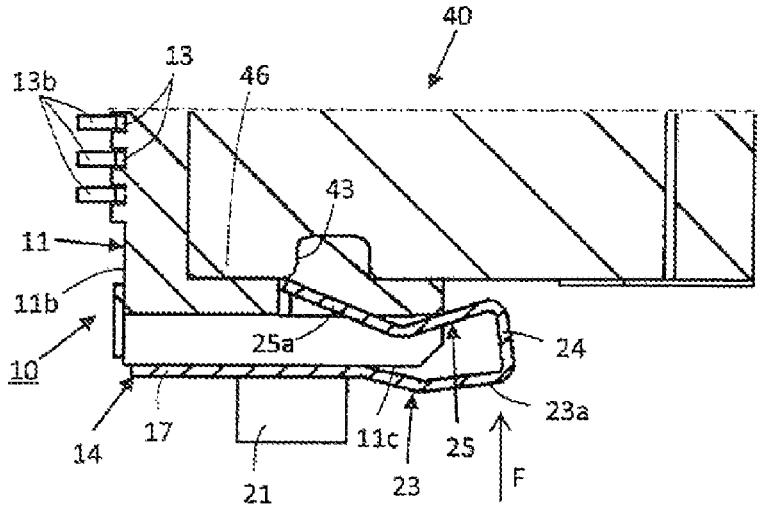
FIG. 18 is a schematic partial cross sectional view showing a situation wherein the releasing member causes the holding portion to release the FPC inserted in the embodiment shown in each of FIGS. 1 and 2 from holding by the holding portion.

After that, as shown in FIG. 18, when the manipulatable part 23*a* of the releasing portion 23 is manipulated with pressure exerted thereon in the direction to the holding portion 25 as shown with the arrow F, the releasing portion 23 is moved to swing with the fulcrum placed at the root of the releasing portion 23 connected with the left side portion 17 of the shell member 14 and thereby the holding portion 25 is caused to come into contact with the contacting portion 31 provided on the housing 11 and to swing with the fulcrum placed at the root of the holding portion 25 connected with the connecting portion 24 so that the engaging end portion 25*a* of the holding portion 25 is moved to approach to the root of the releasing portion 23 connected with the left side portion 17 of the shell member 14 and the top end part of the engaging end portion 25*a* of the holding portion 25 is caused to go away from the inside of the opening 12 provided on the housing 11. Thereby, the top end part of the engaging end portion 25*a* of the holding portion 25 is disengaged from the engaging edged recess 43 provided on the FPC 40 inserted in the housing 11 so that the FPC 40 inserted in the housing 11 is released from holding by the holding portion 25.

Similarly, when the manipulatable part 26*a* of the releasing portion 26 is manipulated with pressure exerted thereon in the direction to the holding portion 28, the releasing portion 26 is moved to swing with the fulcrum placed at the root of the releasing portion 26 connected with the right side portion 18 of the shell member 14 and thereby the holding portion 28 is caused to come into contact with the contacting portion provided on the housing 11 and to swing with the fulcrum placed at the root of the holding portion 28 connected with the connecting portion 27 so that the engaging end portion 28*a* of the holding portion 28 is moved to approach to the root of the releasing portion 26 connected with the right side portion 18 of the shell member 14 and the top end part of the engaging end portion 28*a* of the holding portion 28 is caused to go away from the inside of the opening 12 provided on the housing 11. Thereby, the top end part of the engaging end portion 28*a* of the holding portion 28 is disengaged from the engaging edged recess 44 provided on the FPC 40 inserted in the housing 11 so that the FPC 40 inserted in the housing 11 is released from holding by the holding portion 28.

When the FPC 40 inserted in the housing 11 is released from the holding by each of the holding portions 25 and 28 in such a manner as mentioned above, the FPC 40 inserted in the housing 11 is put in a condition to be caused intentionally to get out of the housing 11.

In the electrical connector 10 thus constituted as the embodiment of electrical connector according to the present invention, as described above, when the FPC 40 is inserted into the housing 11 through the opening 12 provided thereon, the contacting portion 13*a* of each of the conductive contacts 13 arranged on the housing 11 comes into contact with the corresponding one of the signal connecting terminals 41 provided on the FPC 40 inserted in the housing 11 and each of the holding portions 25 and 28 formed in a body in the shell member 14 is put in the engagement with the FPC 40 inserted in the housing 11 for holding the same. As a result, the FPC 40 inserted in the housing 11 are held by the holding portions 25 and 28 so as to be surely prevented from getting out of the housing 11 unwillingly and the conductive contacts 13 arranged on the housing 11 are stably kept in electrical connection with the signal connecting terminals 41 provided on the FPC 40 inserted in the housing 11.

Then, when each of the releasing portions 23 and 26, which are also formed in a body in the shell member 14 in addition to the holding portions 25 and 28, is manipulated to release each of the holding portions 25 and 28 from the engagement with the FPC 40 inserted in the housing 11 under the condition wherein the FPC 40 inserted in the housing 11 is put in the holding by each of the holding portions 25 and 28, the releasing portion 23 is moved to shift the holding portion 25 through the connecting portion 24 so that the holding portion 25 is released from the engagement with the FPC 40 inserted in the housing 11 and the releasing portion 26 is moved to shift the holding portion 28 through the connecting portion 27 so that the holding portion 28 is released from the engagement with the FPC 40 inserted in the housing 11.

As a result, the FPC 40 inserted in the housing 11 is released from the holding by each of the holding portions 25 and 28 so as to be able to get out of the housing 11.

Accordingly, with the electrical connector 10, the FPC 40 inserted in the housing 11 can be put in the holding by the holding portions 25 and 28 formed in a body in the shell member 14 to be surely prevented from getting out of the housing 11 unwillingly and then released from the holding by the holding portions 25 and 28 to be able to get out of the housing 11 with an improved structure with which the electrical connector 10 can be miniaturized on the whole and the number of structural parts can be reduced.

Further, since the releasing portion 23, the connecting portion 24 and the holding portion 25 constitutes the U-shaped portion in the shell member 14 and the releasing portion 26, the connecting portion 27 and the holding portion 28 constitutes also the U-shaped portion in the shell member 14, the holding portion 25 can be shifted in its position on a relatively large scale through the connecting portion 24 with a relatively small-scale movement of the releasing portion 23 caused by the manipulation inflicted on the manipulatable part 23*a* of the releasing portion 23 and the holding portion 28 can be shifted in its position on a relatively large scale through the connecting portion 27 with a relatively small-scale movement of the releasing portion 26 caused by the manipulation inflicted on the manipulatable part 26*a* of the releasing portion 26. As a result, the FPC 40 inserted in the housing 11 can be released from the holding by the holding portions 25 and 28 with an improved structure in which the releasing portions 23 and 26, the connecting portions 24 and 27 and the holding portions 25 and 28 can be miniaturized on the whole.

In addition, since the releasing portion 23 formed in a body in the shell member 14 extends from the left side portion 17 of the shell member 14 covering the left end portion 11*c* of the housing 11 to the outside of the housing 11 on the side of the front end portion 11*a* of the housing 11 and the releasing portion 26 formed in a body in the shell member 14 extends from the right side portion 18 of the shell member 14 covering the right end portion 11*d* of the housing 11 to the outside of the housing 11 on the side of the front end portion 11*a* of the housing 11, the manipulation inflicted on each of the releasing portions 23 and 26 for releasing each of the holding portions 25 and 28 from the engagement with the FPC 40 inserted in the housing 11 does not exert any substantial pressure on the solid circuit board on which the housing 11 is mounted but exerts pressure on each of the left and right end portions 11*c* and 11*d* of the housing 11. As a result, the FPC 40 inserted in the housing 11 can be easily released from the holding by the holding portions 25 and 28 formed in a body in the shell member 14 without exerting undesirable coercive force on the solid circuit board with which the FPC 40 is connected electrically.

Incidentally, although the FPC 40 is inserted in the housing 11 with the first surface thereof provided thereon with the signal connecting terminal 41 and facing upward under a condition wherein the contacting portion 13*a* of each of the conductive contacts 13 provided for coming into contact with the signal connecting terminal 41 on the first surface of the FPC 40 is arranged to project into the inside of the opening 12 provided on the housing 11 from the side of the upper portion 15 of the shell member 14, in the electrical connector 10 described above, it is also possible to modify the electrical connector 10 in such a manner that the FPC 40 is inserted in the housing 11 with the first surface thereof provided thereon with the signal connecting terminal 41 and facing downward under a condition wherein the contacting portion 13*a* of part of the conductive contacts 13 provided for coming into contact with the signal connecting terminal 41 on the first surface of the FPC 40 is arranged to project into the inside of the opening 12 provided on the housing 11 from the side of the lower portion 16 of the shell member 14.

Further, although a group of the releasing portion 23, the connecting portion 24 and the holding portion 25 formed in a body in the shell member 14 and a group of the releasing portion 26, the connecting portion 27 and the holding portion 28 formed in a body in the shell member 14 are provided on the side of the front end portion 11*a* of the housing 11 and each of the holding portions 25 and 28 extends toward the front portion 19 of the shell member 14, in the electrical connector 10 described above, it is further possible to modify the electrical connector 10 in such a manner that the group of the releasing portion 23, the connecting portion 24 and the holding portion 25 formed in a body in the shell member 14 and the group of the releasing portion 26, the connecting portion 27 and the holding portion 28 formed in a body in the shell member 14 are provided on the side of the rear end portion 11*b* of the housing 11 and each of the holding portions 25 and 28 extends toward the rear portion opposite to the front portion 19 of the shell member 14.

The invention claimed is:

1. An electrical connector comprising;

a housing made of insulator to be mounted on a solid circuit board and provided thereon with an opening through which a flat circuit device is inserted into the housing and which opens on one of a first pair of opposite end portions of the housing, a plurality of conductive contacts arranged on the housing, each of which has a contacting portion positioned in the housing and a connecting terminal portion projecting from the other of the first pair of opposite end portions of the housing to the outside of the housing and the contacting portion comes into contact with a connecting terminal provided on the flat circuit device inserted in the housing through the opening provided thereon, and a shell member mounted on the housing for covering partially the same and provided with a holding portion formed in a body therein and operative to be put in engagement with the flat circuit device inserted in the housing for holding the same, a releasing portion formed in the body therein and operative to release the holding portion from the engagement with the flat circuit device inserted in the housing and a connecting portion formed in the body therein for connecting the releasing portion with the holding portion, wherein the releasing portion extends from a portion of the shell member covering one of a second pair of opposite end portions of the housing to the outside of the housing on the side of said one of the first pair of opposite end portions of the housing, the connecting portion extends to be bent from the releasing portion, and the holding portion extends to be bent from the connecting portion toward the other of the first pair of opposite end portions of the housing, so that a U-shaped portion is constituted in the shell member with the releasing portion, the connecting portion and the holding portion.

2. An electrical connector according to claim 1, wherein each of the holding portion and the releasing portion constitutes a resilient movable arm-shaped portion.

3. An electrical connector according to claim 2, wherein the holding portion is provided thereon with an engaging end portion for engaging with an engaging portion provided on the flat circuit device inserted in the housing and operative to swing with a fulcrum placed at a root of the holding portion connected with the connecting portion, and the releasing portion is provided thereon with a manipulatable part on which manipulation for shifting the releasing portion toward the holding portion is exerted and operative to swing with a fulcrum placed at a root of the releasing portion connected with the shell member.

4. An electrical connector according to claim 3, wherein the holding portion is operative to come into contact with a positioning portion provided on the housing to be restricted in position thereby when the manipulatable part of the releasing portion is not manipulated to shift the releasing portion toward the holding portion and operative to come into contact with a contacting portion provided on the housing and move the engaging end portion provided on the holding portion to approach to the root of the releasing portion connected with the shell member when the manipulatable part of the releasing portion is manipulated to shift the releasing portion toward the holding portion.

5. An electrical connector according to claim 4, wherein the holding portion is operative to cause a top end part of the engaging end portion provided on the holding portion to be positioned at the inside of the opening provided on the housing when the holding portion is restricted in position by the positioning portion provided on the housing and then to cause the top end part of the engaging end portion provided on the holding portion to go away from the inside of the opening provided on the housing when the holding portion is operative to shift the engaging end portion provided on the holding portion so as to approach to the root of the releasing portion connected with the shell member.

6. An electrical connector according to claim 1, wherein a couple of sets of the holding portion and the releasing portion of the shell member are formed in a body respectively in a pair of portions of the shell member which cover the second pair of opposite end portions of the housing, respectively.

* * * * *